United States Patent [19]

Powell

[11] Patent Number: 4,674,765

[45] Date of Patent: Jun. 23, 1987

[54] SKI FOR USE IN A MONOSKI

[76] Inventor: William Powell, R.D. 3, Box 95, Andover, N.J. 07821

[21] Appl. No.: 811,448

[22] Filed: Dec. 20, 1985

[51] Int. Cl.[4] ..... A63C 5/03

[52] U.S. Cl. ..... 280/607; 280/618; 280/636; 441/68; 441/70

[58] Field of Search ..... 280/600, 601, 607, 610, 280/636, 617, 618, 633, 809; 441/65, 68, 70, 74, 79

[56] References Cited

U.S. PATENT DOCUMENTS

| | | | |
|---|---|---|---|
| 234,655 | 11/1880 | Caldwell et al. | 280/607 |
| 3,416,810 | 12/1968 | Kennedy, III | 280/610 |
| 3,802,714 | 4/1974 | Freegard | 280/607 |
| 3,806,144 | 4/1974 | Yans et al. | 280/636 |
| 3,944,238 | 3/1976 | Weigl et al. | 280/636 |
| 4,008,908 | 2/1977 | Pierson | 280/607 |
| 4,022,491 | 5/1977 | Powell | 280/607 |
| 4,227,274 | 10/1980 | Richardson | 441/68 |
| 4,519,625 | 5/1985 | Luitz et al. | 280/617 |

FOREIGN PATENT DOCUMENTS

| | | | |
|---|---|---|---|
| 2455907 | 1/1981 | France | 280/607 |
| 62677 | 7/1940 | Norway | 280/610 |
| 18084 | 12/1903 | Sweden | 280/601 |

*Primary Examiner*—John J. Love
*Assistant Examiner*—Eric D. Culbreth
*Attorney, Agent, or Firm*—Alfred C. Hill

[57] ABSTRACT

The ski comprises an elongated body member having an upwardly turned tip portion on one end of the body member, a tail portion on the other end of the body member, a lower gliding surface extending between the tip portion and the tail portion and an upper surface coextensive with the lower surface. The upper surface includes a raised portion at a predetermined location between the tip portion and the tail portion with this raised portion being integral with the remainder of the upper surface and being capable of supporting at least one foot of a skier.

6 Claims, 6 Drawing Figures

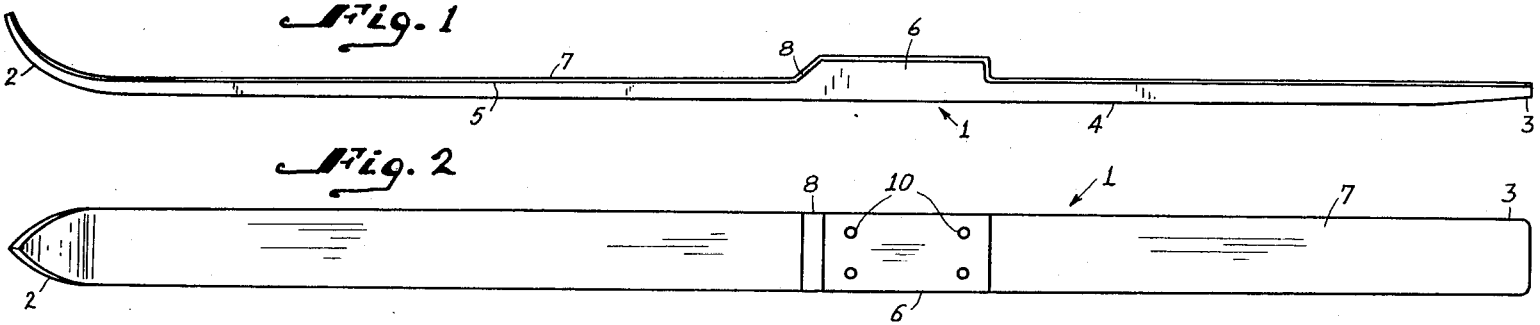
Fig. 1
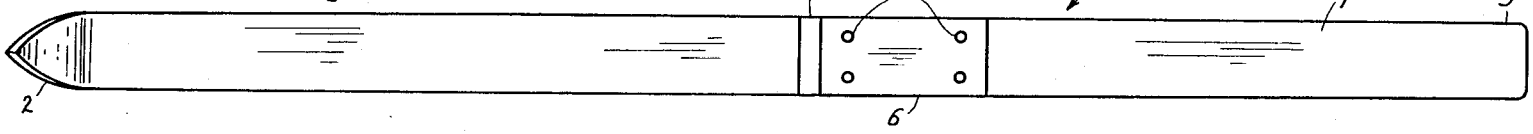
Fig. 2
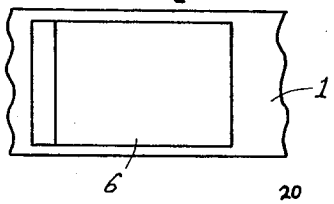
Fig. 6
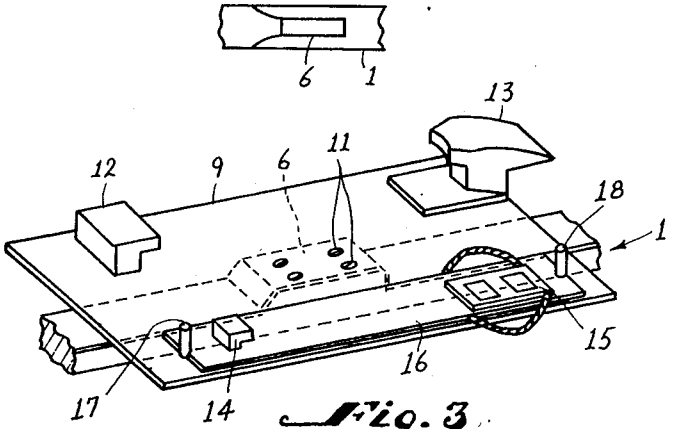
Fig. 3
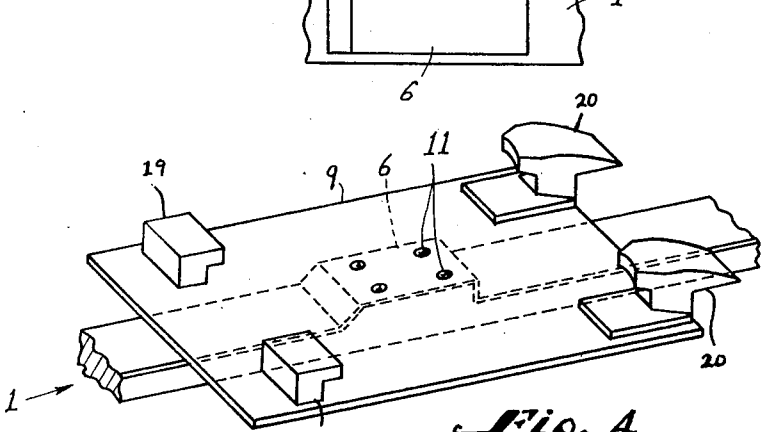
Fig. 4
Fig. 5

SKI FOR USE IN A MONOSKI

BACKGROUND OF THE INVENTION

The present invention relates to skis of the snow and water type and more particularly to an improved ski for use in a monoski.

The term "monoski" is a term customarily used for water skiing, since the skier stands on a single ski or runner member.

The usual difficulties which are to be dealt with when using conventional skis comprise the maintenance of an ideal body position which will vary according to the speed and running situation, the displacement of body weight from one ski to the other and the command of the ski edges connected with such body displacement, the guidance of the skis, particularly their maintenance of a parallel position and finally the adoption of the position of the skis and of the position of the body to the ground and the track to be followed.

These difficulties usually are gradually overcome by the skier with increasing ability, but a great amount of strength and concentration is needed which diminishes the pleasure of skiing and results in a retardation of the excursion on skis. When the skis are not maintained in exact parallelism, one or the other ski not only moves in a longitudinal direction but will also skid laterally which will slow down the running speed.

When skiing over undulated ground, particularly when crossing the undulations at an angle other than right angles, a considerable expenditure of force is required to keep the skis parallel to each other.

The novice in skiing will always have considerable difficulties in learning to keep the two skis in parallel position which allows skiing without fatigue.

The use of a monoski overcomes these difficulties and enables the skier to enjoy skiing to a greater extent.

Known monoskis include a ski having a width wide enough to support both feet of the skier on the surface of the elongated ski.

Another type of prior art monoski is that type including a platform for both feet of a skier elevated above the surface of the ski or ski member supported in this elevated position by one or two columns with the base of the columns secured to the upper surface of the ski or skid member.

SUMMARY OF THE INVENTION

An object of the present invention is to provide an improved ski for use in a monoski.

A feature of the present invention is the provision of a ski comprising an elongated body member having an upwardly turned tip portion on one end of the body member, a tail portion on the other end of the body member, a lower gliding surface extending between the tip portion and the tail portion and an upper surface coextensive with the lower surface, the upper surface having a raised portion at a predetermined location between the tip portion and the tail portion, the raised portion being integral with the remainder of the upper surface and being capable of supporting at least one foot of a skier.

Another feature of the present invention is the provision of first means disposed in the raised portion to secure second means to the raised portion capable of supporting both feet of the skier in a side-by-side relationship.

BRIEF DESCRIPTION OF THE DRAWING

Above-mentioned and other features and objects of the present invention will become more apparent by reference to the following description taken in conjunction with the accompanying drawing, in which:

FIG. 1 is a side view of a ski in accordance with the principles of the present invention;

FIG. 2 is a top view of the ski of FIG. 1;

FIG. 3 is a perspective view illustrating an embodiment of a ski of FIGS. 1 and 2 modified to provide a monoski;

FIG. 4 is a perspective view of a second embodiment of the ski of FIGS. 1 and 2 modified to provide a monoski; and FIGS. 5 and 6 are fragmentary top views of two modifications of the FIGS. 1 and 2.

DESCRIPTION OF THE PREFERRED EMBODIMENTS

Referring to FIGS. 1 and 2, the ski in accordance with the principles of the present invention comprises an elongated body member 1 having an upwardly turned tip portion 2 on one end of body member 1, a tail portion 3 on the other end of body member 1, a lower gliding surface 4 extending between tip portion 2 and tail portion 3 and an upper surface 5 coextensive with lower surface 4. Upper surface 5 has formed integrally therewith a raised portion 6 at a predetermined location between tip portion 2 and tail portion 3. The raised portion 6 is capable of supporting at least one foot of a skier at least through an intermediary arrangement.

The upper surface 5 has disposed thereon a non-stick material 7 which not only covers upper surface 5 but also the surface of raised portion 6. This non-stick material could be aluminum oxide if the body member 1 had a coating of aluminum thereon with the aluminum oxide being provided by anodizing the aluminum coating of body member 1. The non-stick layer 7 could also be provided by a coating of plastic material, such as Teflon.

As in my copending application Ser. No. 811,290, filed Dec. 20, 1985, the non-stick layer 7 is for the purpose of preventing an accumulation of the skiing medium on the ski, particularly when skiing in snow.

At least the forward surface 8 of raised portion 6 is streamlined to reduce the drag of the ski in the skiing medium, such as water or snow.

Referring to FIG. 3, there is illustrated therein one modification to the ski of FIGS. 1 and 2 to provide a monoski. This modification includes a flat plate 9 secured to the raised portion 6 by some appropriate means, such as by providing a plurality of tapped holes 10 in raised portion 6 into which each of a plurality of bolts are threaded after extending through the flat plate 9.

To the upper surface of plate 9 are attached a pair of feet retaining means to position both feet of the skier in a side-by-side relationship. For purposes of illustration, ski boot retaining means are illustrated, but it should be recognized that these feet retaining means illustrated could be modified and replaced by normal feet retaining means employed in a water ski.

As illustrated a ski boot toe retaining means 12 is provided for one foot of the skier with its companion heel retaining means 13. The other foot of the skier as illustrated in FIG. 3 is releasably retained by toe and heel retainers 14 and 15 mounted on a slide plate 16 which is in turn releasably mounted on the upper surface of flat plate 9 by means illustrated as posts 17 and 18.

As in my copending application Ser. No. 811,290, filed Dec. 20, 1985, slide plate 16, which can also be called a small ski, can be instantaneously released from plate 9 to enable the skier to use slide plate 16 to aid in overcoming loss of balance, getting on and off chair lifts, riding T-bars and poma lifts and should a skier find him or herself on a slope he or she can not handle, he or she can use slide plate 16 and body member 1 (the large ski) to make it down the slope with confidence.

According to FIG. 3 the right foot of the skier is retained in the conventional releasable boot retainer while the left foot of the skier is retained in a slide plate mechanism which is releasably secured to the flat plate 9. It should be recognized that the two different retaining arrangements can be interchanged so that the conventional boot retainer is used for the left foot of the skier and the slide plate retaining arrangement is used for the right foot of the skier.

Referring to FIG. 4, the modification of the ski of FIGS. 1 and 2 again encompasses a flat plate 9 fastened to raised portion 6 such as by using tapped holes 10 in raised portion 6 and bolts 11 extending through plate 9 and threaded into the tapped holes 10. In this arrangement each foot of the skier is retained in identical or different conventional ski boot retainers. Each of the retainers include a toe portion 19 and a heel portion 20. Each of the toe portions 19 and heel portions 20 are in a side-by-side relationship so as to releasably fasten both feet of the skier to the monoski in a side-by-side relationship.

Plate 9 of FIGS. 3 and 4 and plate 16 of FIG. 3 can also have a non-stick surface like surface 7 to prevent accumulation of the skiing medium thereon, particularly when skiing in snow.

The height of raised portion 6 is determined by the width of body member 1. Raised portion 6 would be higher for a conventional ski having a width in the order of $2\frac{3}{4}$ inches and lower for a wider non-conventional ski having a width in the order of 6 to 8 inches. A 6 inch width is not wide enough to support both feet of a skier in a side-by-side relationship while a 8 inch width could possibly support both feet of a skier in a side-by-side relationship.

Referring to FIG. 5, body member 1 has a narrow width and raised portion 6 has a width narrower than the width of body member 1. To support one foot or both feet of a skier a plate similar to plate 9 of FIGS. 3 and 4 with its feet retainers would have to be fastened to raised portion 6.

Referring to FIG. 6, body member 1 has a wide width in the order of 6 inches or more and raised portion 6 can have a width equal to or less than the width of body member 1. If the raised portion 6 has a width that can't support both feet of a skier in a side-by-side relationship then again a plate similar to plate 9 of FIGS. 3 and 4 with their feet retainers would have to be fastened to raised portion 6.

As will be observed the width of raised portion 6 can be less than the width of body member 1 or equal to the width of body member 1 regardless of the width of body member 1.

While I have described above the principles of my invention in connection with specific apparatus, it is to be clearly understood that this description is made only by way of example and not as a limitation to the scope of my invention as set forth in the objects thereof and in the accompanying claims.

I claim:

1. A ski comprising:

an elongated body member having an upwardly turned tip portion on one end of said body member, a tail portion on the other end of said body member, a lower gliding surface extending between said tip portion and said tail portion, and an upper surface coextensive with said lower surface, said upper surface having provided therein a single raised portion at a predetermined location between said tip portion and said tail portion, said raised portion being integral and continuous with the remainder of said upper surface;

first means capable of supporting both feet of a skier in a side-by-side relationship; and second means to secure said first means to said raised portion;

said first means including a flat plate secured to said raised portion by said second means, a toe retaining means and a heel retaining means directly secured to said flat plate to releasably fasten one foot of said skier to said flat plate, a slide plate having toe and heel retaining means secured thereon to releasably fasten the other foot of said skier to said slide plate, and third means mounted on said flat plate to releasably fasten said slide plate to said flat plate.

2. A ski according to claim 1, wherein said flat plate is wider than said raised portion.

3. A ski according to claim 1, wherein at least said upper surface and said raised portion have a non-stick finish thereon.

4. A ski according to claim 3, wherein at least the front surface of said raised portion is streamlined to reduce drag in a skiing medium.

5. A ski according to claim 1, wherein at least the front surface of said raised portion is streamlined to reduce drag in a skiing medium.

6. A ski according to claim 1, wherein said second means includes a plurality of tapped holes in said raised portion and a plurality of bolts each extending through said flat plate and threaded into an associated one of said plurality of tapped holes.

* * * * *